US005874923A

United States Patent [19]

Nilsson et al.

[11] Patent Number: 5,874,923

[45] Date of Patent: Feb. 23, 1999

[54] FEEDER HORN, INTENDED PARTICULARLY FOR TWO-WAY SATELLITE COMMUNICATIONS EQUIPMENT

[75] Inventors: Mats Nilsson, Saltsjöbaden, Sweden; Kari Tiihonen, Järvenpää, Finland

[73] Assignee: Trulstech Innovation Handelsbolag, Saltsjobaden, Sweden

[21] Appl. No.: 776,328

[22] PCT Filed: Jul. 20, 1995

[86] PCT No.: PCT/SE95/00878

§ 371 Date: Jan. 27, 1997

§ 102(e) Date: Jan. 27, 1997

[87] PCT Pub. No.: WO96/04693

PCT Pub. Date: Feb. 15, 1996

[30] Foreign Application Priority Data

Jul. 28, 1994 [SE] Sweden ..... 9402587

[51] Int. Cl.[6] ..... H01Q 13/00

[52] U.S. Cl. ..... 343/786; 343/776; 333/135

[58] Field of Search ..... 343/776, 786; 333/21 A, 21 R, 135, 137; H01Q 13/02, 13/00

[56] References Cited

U.S. PATENT DOCUMENTS

| | | | |
|---|---|---|---|
| 2,751,586 | 6/1956 | Riblet | 343/776 |
| 3,482,251 | 12/1969 | Bowes, Jr. | 343/776 |
| 3,495,262 | 2/1970 | Paine | 343/776 |
| 3,633,208 | 1/1972 | Ajioka | 343/786 |
| 4,712,110 | 12/1987 | Branigan et al. | 343/779 |
| 4,972,199 | 11/1990 | Raghavan et al. | 343/776 |
| 5,113,197 | 5/1992 | Luh | 343/776 |
| 5,406,298 | 4/1995 | Walterr | 343/776 |

*Primary Examiner*—Don Wong
*Assistant Examiner*—Tan Ho
*Attorney, Agent, or Firm*—Jacobson, Price, Holman & Stern, PLLC

[57] ABSTRACT

A feeder horn for two-way satellite telecommunications includes a center transmitter/receiver horn (10) and at least three separate measuring (11, 12, 13) which are positioned symmetrically relative to the symmetry (O) of the feeder horn. All horn are produced mechanically in a one-piece metal structure (1) which includes the transmitter/receiver horn (10) accommodating and through-penetrating a center opening (100) which merges with a transmitter waveguide (101) and a receiver waveguide (102) which are separated by a filter of the orthomode transducer type (OMT), which is constructed for separating differing polarizations and comprises an output to the center opening (100) of the metal structure and two inputs to respective waveguide for the transmitter and receiver waveguides; wherein the metal structure further includes a bottom-defined opening (110, 120, 130) for each of the measuring horns, a switching device (111, 121, 131) anchored in the metal structure for each of the measuring horns and moat-like channels (104, 114, 124, 134) provide around each opening (100, 110, 120, 130) in the metal structure, to isolate electromagnetically each horn in relation to each other horn.

4 Claims, 1 Drawing Sheet

FEEDER HORN, INTENDED PARTICULARLY FOR TWO-WAY SATELLITE COMMUNICATIONS EQUIPMENT

TECHNICAL FIELD

The present invention relates to a feeder horn intended particularly for two-way satellite telecommunication equipment, and more particularly to such a horn that includes a central transmitter/receiver horn and at least three separate measuring horns which are positioned symmetrically relative to the symmetry line of the feeder horn.

DESCRIPTION OF THE BACKGROUND ART

The mechanical and electrical components of satellite communications equipment intended particularly for marine applications must be of a very high quality that will guarantee a smooth and continuous operating time of at least about two years before the event of a malfunction. It can be mentioned as an example that the mechanical gyros available do not provide information on very small changes occurring in the three-dimensional space. The mechanism of such gyros is encumbered with a large intrinsic inertia which makes it impossible to handle information quickly enough to compensate for the rapid but small changes to which the equipment can be subjected in marine environments.

Equipment of this kind includes control systems which receive input data from transmitters in positioning systems. This input data is updated against non-linearity and operation due to thermic influences in electronic systems among other things, by calibrating actively against a "true" signal, ie the signal that is received by an antenna and that has its origin from the target object, the satellite, concerned, whose elevation and azimuth are well-defined for those geostationary satellites that can constitute a reference for "true" calibration.

It is only possible to satisfy the required tracking accuracy of 0.1°, by using an efficient and highly effective tracking system which is fast enough to track continuously satellite transmitted signals and to register any deviations that might occur in the X:Y:Z-directions. Those products that are available commercially at present are associated with very high investment costs (in the order of about SEK 1,000,000:-). Furthermore, it is difficult to find technical solutions that would enable the cost to be reduced by manufacturing in large numbers.

The object of the present invention is to eliminate the aforesaid drawbacks of a technical and economic nature.

The novel and inventive feeder horn is based on the basic concept of producing a physical phase difference between incoming signals solely mechanically. The characteristic features of an inventive feeder horn are set forth in the following claims.

SUMMARY OF THE INVENTION

An inventive feeder horn of the aforesaid kind is characterized in that all horns are produced mechanically in a one-piece metal structure which includes a transceiver-horn accommodating through-penetrating centre opening which merges with a transmitter waveguide and a receiver waveguide separated by filters of the orthomode transducer kind (OMT), wherein switch means for each of the measuring horns are anchored in the metal structure, and wherein moat-like channels are provided around each opening in the metal structure, to isolate electromagnetically each horn in relation to remaining horns.

BRIEF DESCRIPTION OF THE DRAWINGS

The invention will now be described with reference to the accompanying schematic drawings, in which.

DESCRIPTION OF PREFERRED EMBODIMENTS

Figure 1:
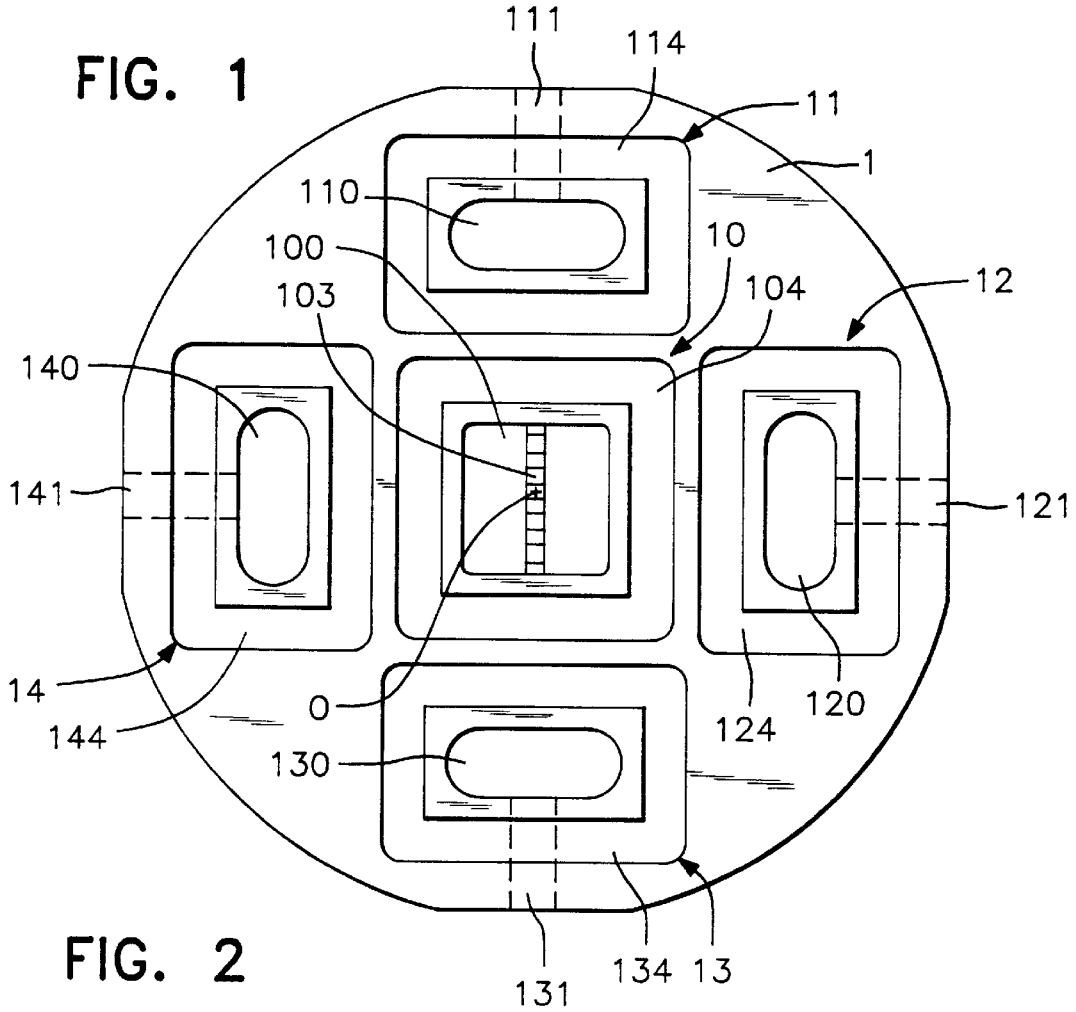
FIG. 1 illustrates schematically one embodiment of an inventive feeder horn from above.
Figure 2:
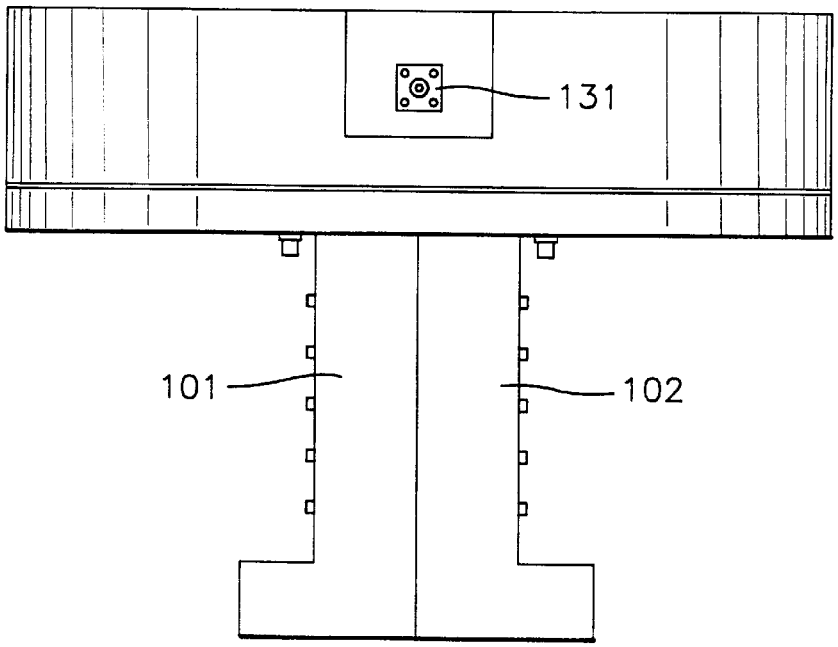
FIG. 2 is a side view of the horn shown in FIG. 1.

The illustrated feeder horn includes a centrally positioned transceiver horn 10 and four separate measuring horns 11, 12, 13, 14 which are placed symmetrically in relation to the symmetry line O of the feeder horn at right angles to the plane of the drawing.

All horns are produced mechanically in one and the same metal structure 1. The transceiver horn 10 has a through-penetrating opening 100 which merges with a transmitter waveguide 101 and a receiver waveguide 102 which are separated by an orthomode transducer type filter 103 (an OMT-filter). Each of the measuring horns 11, 12, 13, 14 has a bottom-limited opening 110, 120, 130, 140. The one-piece metal structure 1 has anchored therein a switch device 111, 121, 131, 141, e.g. in the form of a measuring probe, for each respective measuring horn.

A moat-like channel 104, 114, 124, 134, 144 is provided around each respective opening 110, 110, 120, 130, 140 so as to isolate each horn electromagnetically from each other horn.

The aforedescribed feeder horn having four measuring horns 11, 12, 13, 14 is intended for satellite communications with a relatively small frequency difference between transmission and reception frequencies, e.g. a frequency difference of 1:1.05.

The central opening 100 has a square shape and the sides of the openings 110, 120, 130, 140 of the measuring horns 11, 12, 13, 14 and the sides of the moat-like channels 114, 124, 134, 144 are essentially parallel with corresponding sides of the opening-100 and the moat-like channel 104 in the transceiver horn 10.

A slightly modified embodiment of the feeder horn is intended for satellite communications with a relatively large frequency difference between transmission frequency and reception frequency, e.g. a frequency difference of 1:1.5. The measuring horns are still four in number, but the central opening 100 and the moat-like channels 104 have a circular shape and the sides of the openings 110, 120, 130, 140 of the measuring horns 11, 12, 13, 14 and the sides of the moat-like channels 114, 124, 134, 144 are essentially parallel with corresponding sides of the opening 100 and the moat-like channel 104 in the transceiver horn.

Alternatively, the feeder horn 10 may be provided with three symmetrically positioned measuring horns 11, 12, 13. The openings and moat-like channels may also be square or circular in shape in this case, depending on whether the difference between transmission frequency and reception frequency is small or large.

If an antenna that has a feeder horn which includes four measuring horns is rotated so that a frequency diagram set-up for a signal received by the measuring horns and transmitted from a satellite obtains a common point of intersection, this point will represent the condition that all four measuring heads are "offset" equally from the signal source (the satellite), i.e the antenna reflector is directed optimally onto the chosen satellite.

The feeder horn equipped with four measuring horns can be produced to a degree of accuracy which will fulfill the requirement of an isolation of at least 40 Db between the measuring horns and an isolation of at least 100 dB between measuring horns and transceiver horn. This means that transmission powers of about 100 watts within the 14 GHz-range will be prevented from giving rise to electromagnetic noise in an adjacent measuring horn present in the same metal structure and having a receiving frequency within the 12 GHz-range. Calculations indicate that the construction lends itself to economically viable mass production. It is believed that mass produced constructions will cost at most one tenth of the cost of corresponding constructions produced in accordance with known techniques.

It can be mentioned that the bottom-defined openings (110, 120, 130, 140) of the measuring horns enable external filters to be connected to the measuring horns (11, 12, 13, 14) and that the switch devices (111, 121, 131, 141) anchored in the one-piece metal structure (1) enable measuring probes to be fitted after connecting an external waveguide filter to each of the measuring horns.

We claim:

1. A feeder horn intended particularly for two-way satellite telecommunication equipment which includes a central transmitter/receiver horn (10) and at least three separate measuring horns (11, 12, 13) which are positioned symmetrically relative to the symmetry line (O) of the feeder horn, characterized in that all horns are produced mechanically in a one-piece metal structure (1) which includes the central transmitter/receiver horn (10) accommodating and through-penetrating a centre opening (100) which merges with a transmitter waveguide (101) and a receiver waveguide (102) which are separated by a filter of the orthomode transducer type (OMT), which is constructed for separating differing polarizations and comprises an output to the central opening of the metal structure and two inputs to respective waveguides for the transmitter and receiver waveguides;

wherein the metal structure further includes a bottom-defined opening (110, 120, 130) for each of the measuring horns (11, 12, 13), a switching device (111, 121, 131) anchored in the metal structure (1) for each of the measuring horns (11, 12, 13), and moat-like channels (104, 114, 124, 134) provided around each opening (100, 110, 120, 130) in the metal structure, to isolate electromagnetically each horn in relation to each other horn.

2. A feeder horn according to claim 1, characterized in that the measuring horns (11, 12, 13) are three in number.

3. A feeder horn according to claim 1 intended for satellite communications with relatively small difference between transmission and reception frequencies, characterized in that the measuring horns (11, 12, 13, 14) are four in number; in that the central opening (100) is square in shape; and in that the sides of the openings (110, 120, 130, 140) of the measuring horns and the sides of the moat-like channels (114, 124, 134, 144) are essentially parallel with corresponding sides of the opening (100) and the moat-like channel (104) in the transceiver horn.

4. A feeder horn according to claim 1 intended for satellite communications with relatively large difference between transmission and reception frequencies, characterized in that the measuring horns (11, 12, 13, 14) are four in number; in that the central opening (100) is circular in shape; and in that the sides of the openings (110, 120, 130, 140) of the measuring horns and the sides of the moat-like channels (114, 124, 134, 144) are essentially similar to corresponding sides of the opening (100) and the moat-like channel (104) of the transceiver horn.

* * * * *